United States Patent [19]

Rosenthal

[11] Patent Number: 4,821,542

[45] Date of Patent: Apr. 18, 1989

[54] KEY POSITIONING APPARATUS

[76] Inventor: J. Scott Rosenthal, 2113 Curtis Ave., Redondo Beach, Calif. 90278

[21] Appl. No.: 220,600

[22] Filed: Jul. 18, 1988

[51] Int. Cl.[4] ..... E05B 15/08

[52] U.S. Cl. ..... 70/454; 70/207

[58] Field of Search ..... 70/454, 453, 207, 224, 70/375, 452

[56] References Cited

U.S. PATENT DOCUMENTS

| | | | |
|---|---|---|---|
| 2,566,490 | 9/1951 | Heinz | 70/454 |
| 2,941,392 | 6/1960 | Byrne | 70/454 |
| 2,942,452 | 6/1960 | Marchese | 70/454 |
| 2,993,362 | 7/1961 | Bacoolla | 70/454 |
| 4,295,350 | 10/1981 | Grinage | 70/454 |
| 4,539,829 | 9/1985 | Givol | 70/454 |

FOREIGN PATENT DOCUMENTS

| | | | |
|---|---|---|---|
| 812290 | 12/1951 | Fed. Rep. of Germany | 70/454 |

*Primary Examiner*—Robert L. Wolfe

*Attorney, Agent, or Firm*—Blakely, Sokoloff, Taylor & Zafman

[57] ABSTRACT

An apparatus for positioning a key at the keyhole of a lock. The apparatus includes a hollow, funnel-shaped element having a wide end and a narrow end. The wide end defines a wide opening which is sufficiently large, and the funnel-shaped element is sufficiently deep, to permit the partial introduction of the index finger and thumb of the user holding the key into the funnel-shaped element. The apparatus also includes means for securing the funnel-shaped element in a position adjacent the keyhole so that the narrow end is located adjacent the periphery of the keyhole during use. The narrow end defines an opening which is larger than the keyhole but sufficiently narrow to enable the user to accurately locate the keyhole.

4 Claims, 1 Drawing Sheet

KEY POSITIONING APPARATUS

BACKGROUND OF THE INVENTION

1. Field of the Invention

This invention relates to locks with keyholes and more particularly to an apparatus for positioning a key at the keyhole of a lock.

2. Description of the Prior Art

Many people encounter difficulty in opening doors due to the fact that locating the position of the keyhole is difficult for them. These difficulties may be encountered due to blindness or decreased vision. If an area near the subject door is poorly illuminated, i.e. inside a long hallway or outside at night, even those people with normal vision may have difficulty locating the keyhole with their key.

The principal method in the prior art for attempting to solve this problem has been by providing lock illuminating systems. Examples of these systems are noted below:

U.S. Pat. No. 4,775,067, entitled "Door Lock Illuminating System", issued to D. L. Rowe.

U.S. Pat. No. 4,041,301, entitled "Key Illuminating Door Handle", issued to P. F. Pelchat.

U.S. Pat. No. 4,024,413, entitled "Sensalight", issued to S. G. Olita.

U.S. Pat. No. 3,162,374, entitled "Illuminating Means for the Keyhole of Door Locks", issued to L. Skokut.

However, the prior art illuminating systems generally have complicated electronics and are consequently quite expensive. Furthermore, an illuminating system provides no advantages for blind persons.

In view of the vastly growing elderly population with associated vision problems, a new approach for solving the problem of accessing locks with a key is required.

OBJECTS AND SUMMARY OF THE INVENTION

It is therefore a principal object of the present invention to enable those who are blind or partially blind to easily locate the keyhole of a lock with their key.

It is another principal object to enable the easy determination of the location of a keyhole in areas where there is poor lighting.

It is another object to provide an inexpensive apparatus for easily locating a keyhole.

Other objects, advantages and novel features of the present invention will become apparent from the following detailed description of the invention when considered in conjunction with the accompanying drawing.

These objects are achieved by the present invention which is an apparatus for positioning a key at the keyhole of a lock.

In its broadest aspects, the apparatus comprises a hollow, funnel-shaped element and means for securing the funnel-shaped element in a position adjacent the keyhole so that the narrow end of the funnel-shaped element is located adjacent the periphery of the keyhole during use. The wide end of the funnel-shaped element forms an opening which is sufficiently large, and the funnel is sufficiently deep, to permit the partial introduction of the index finger and thumb of the user holding the key into said funnel-shaped element. Thus, the subject invention serves as a guide for the user when attempting to locate the keyhole, the narrow opening being sufficiently narrow so as to enable the user to accurately locate the keyhole. In a preferred embodiment, the funnel-shaped element is secured to the core of a door lock by means of a flange extending substantially perpendicular from the narrow end of the funnel. The flange abuts and is securely fastened to the core by screws or strong adhesive glue.

The invention provides an inexpensive alternative to prior art key locating devices which require relatively expensive electronic circuits for illuminating the area around the keyhole. Furthermore, it is particularly useful for blind persons for whom even an electronic illuminating system would provide no benefits.

BRIEF DESCRIPTION OF THE DRAWINGS

The same elements or parts throughout the figures of the drawings are designated by the same reference characters, while equivalent elements bear a prime designation.

DETAILED DESCRIPTION OF THE INVENTION

Figure 1:
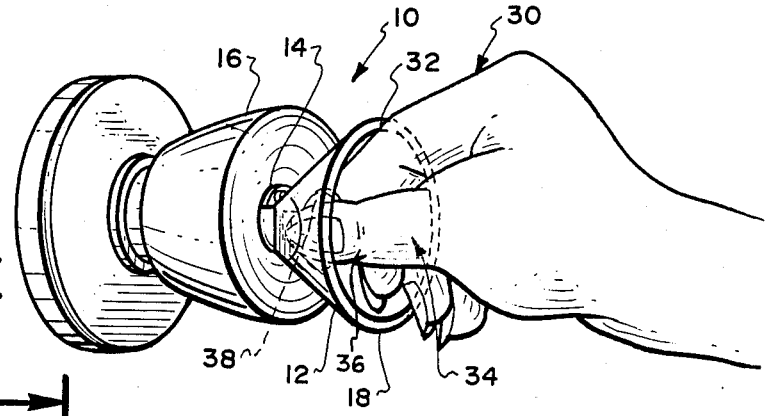
FIG. 1 is a perspective view of the present invention being utilized with a doorknob, the user's fingers accurately positioning the key within the keyhole.

Referring to the drawings and the characters of reference marked thereon, a preferred embodiment of the present invention is shown designated generally 10. The apparatus 10 includes a hollow, funnel-shaped element 12 which is attached to the core 14 of a door lock on a doorknob 16.

Figure 2:
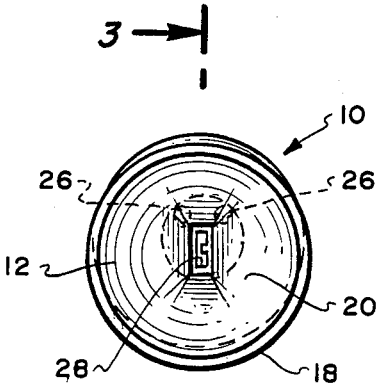
FIG. 2 is an end view of the present invention secured to a door lock.
Figure 3:
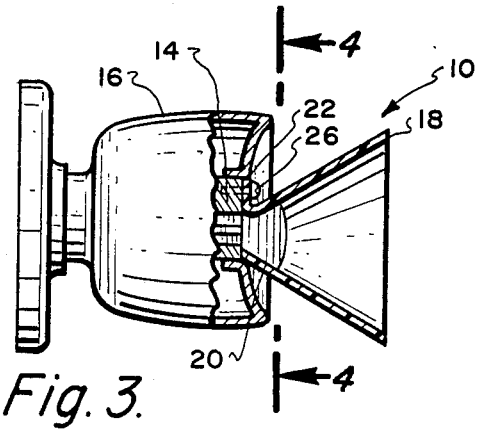
FIG. 3 is a side elevation view, partially in cross-section, of the present invention, taken along line 3—3 of FIG. 2.

As can be seen with reference to FIGS. 1–3, the funnel-shaped element 12 has a wide end 18 and a narrow end 20. The narrow end 20 is located adjacent the door lock 14.

Figure 4:
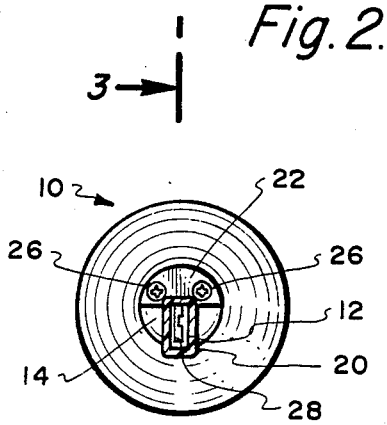
FIG. 4 is a view taken along long 4—4 of FIG. 3.

Funnel-shaped element 12 is securely attached to the core 14 by means of a flange 22 which extends radially outward from the narrow end 24, i.e. in a direction substantially parallel to the outer surface of the core. The flange has two holes for insertion of screws 26. As described in more detail below, it is within the scope of the invention to use other suitable fastening means. Screws 26 provide a rigid attachment of the flange 22 to the core 14. As most clearly shown in FIG. 4, most door lock cores have a keyhole 28 which is off-centered. Therefore, the flange 22 is constructed to be attached to the surface of the core 14 sufficiently distant from the keyhole 28 to allow insertion of screws 26 without interfering with the principal operation of the core 14.

The funnel-shaped element 12 is preferably formed of a semi-rigid plastic. It must be sufficiently flexible to allow the use of a screwdriver to tighten the screws. On the other hand, it must be sufficiently rigid to provide the necessary support and guidance for the user's fingers during its operation.

Referring again to FIG. 1, it is illustrated that the size of the funnel-shaped element 12 is optimized for ease in use. The wide outer end 18 forms a sufficiently wide opening and the element 12 is sufficiently deep to allow introduction of the index finger 30 of the user to approximately the distal interphalangeal joint 32 and the introduction of the thumb 34 to its respective interphalangeal joint 36. Thus, the element 12 functions in its intended use without denying easy access to the doorknob 16 by the user after the key 38 has been inserted. The wide end 18 is preferably round so as to more closely match the shape of the doorknob 16 and the user's fingers. The narrow end 20 is preferably rectangular to match the shape of the keyhole 28 and therefore provide more efficient use.

During operation of apparatus 10, the user, perhaps a partially blind or completely blind person, or a user entering from a poorly lit area, can easily locate the wide end 18 of the funnel-shaped element 12 by feel. The user's index finger and thumb 30,34 which are holding the key 38 are then guided along the inner surface of the element 12 to the correct location and orientation so as to be inserted into the keyhole 28. When the key 38 is in place within the keyhole 28 and turned, the element 12 turns also, thereby preventing any discomfort by its use.

Although the apparatus 10 has been described with its use relative to a doorknob, it is understood that it may be utilized with any type of key/keyhole locking mechanism having a core with sufficient area to allow attachment of the funnel-shaped element 12.

Figure 6:
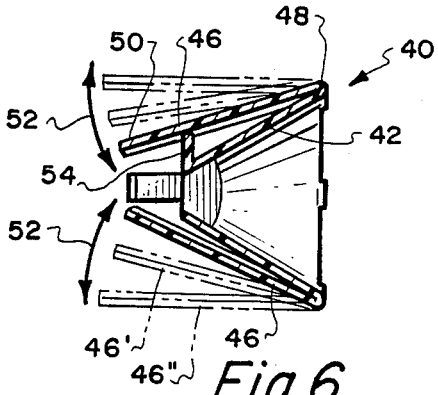
FIG. 6 is a side elevation view, partially in cross-section, of the embodiment of FIG. 5 illustrating the adaptability of the device for varying sizes of doorknobs.
Figure 5:
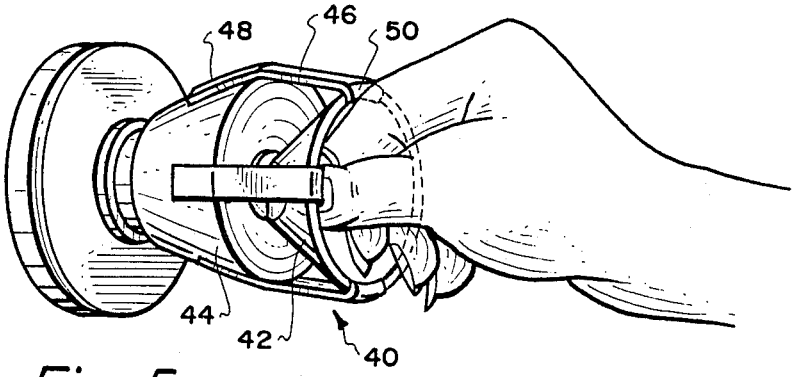
FIG. 5 is a perspective view of an alternative embodiment of the present invention which utilizes elongated support members to secure the funnel to the doorknob.

Referring now to FIGS. 5–6, another embodiment of the present invention is illustrated, designated generally as 40. In this embodiment, the funnel-shaped element 42 is secured to the doorknob 44 by means of support members or elongated strips 46. One end 48 of each strip 46 is attached to (or is integral with) the funnel-shaped element 42 while the other end 50 is attachable to the sidewall of the doorknob 44. As shown by arrows 52 in FIG. 6, the strips 46 may be flexible (see positions 46',46'') to provide for varying sizes of doorknobs. A tab 54 is provided to allow the user to orient the element 42 in the proper orientation.

Furthermore, the elongated strips 46 may be designed with sufficient strength and resiliency to provide a spring-like gripping action against the doorknob to obviate either the need for screws or adhesive glue.

Although FIG. 6 shows the support for the funnel-shaped element 42 to consist of several strips 46, the element 42 may be supported by a single trunicated conically-shaped support serving the same function.

Obviously, many modifications and variations of the present invention are possible in light of the above teachings. It is therefore to be understood that, within the scope of the appended claims, the invention may be practiced otherwise than as specifically described.

For example, although a single flange is shown in the figures, two or more separated flanges may be utilized.

Furthermore, it is emphasized that although the FIG. 1 embodiment is illustrated as being attached to a doorknob, the apparatus 10 may be easily used with the type of locking mechanism in which the lock is located on the door adjacent the doorknob. Many door locks of these types have cores which are wider than those found on doorknobs, thereby lending themselves particularly adaptable to using the present invention. With such a large core, two or three equidistantly-spaced flanges might be used for optimal stress distribution.

Although it was noted that the subject invention preferably has a circular wide end and rectangular narrow end, the scope of the invention is not limited to those specific shapes. For example, the narrow end might have an oblong shape which conforms closely enough to the shape of the keyhole so as to provide functionality but doesn't present such a departure in shape from the wide end as a rectangular narrow end would.

As previously mentioned, fastening means other than screws may be utilized to secure the flange means to the core. For example, an adhesive glue such as an epoxy resin with catalyst-type adhesive or other relatively high strength glue can provide the necessary hold. Use of an adhesive obviates the requirement that the funnel-shaped element be flexible. Thus, in this instance a metal or metal alloy might be utilized.

What is claimed and desired to be secured by letters patent of the United States is:

1. An apparatus for positioning a key at the keyhole of a lock, comprising:

a hollow, funnel-shaped element having a wide end and a narrow end, said wide end defining a wide opening, said wide opening being sufficiently large and said funnel-shaped element being sufficiently deep to permit the partial introduction of the index finger and thumb of the user holding the key into said funnel-shaped element, said narrow end defining a narrow opening; and means for securing said funnel-shaped element in a position adjacent said keyhole so that said narrow end is located adjacent the periphery of the keyhole during use, said narrow opening being wider than the keyhole but sufficiently narrow to enable the user to accurately locate the keyhole, said means for securing said funnel-shaped element including, at least one flange extending from said narrow end in a direction substantially parallel to an outer surface of a core of the lock, said core defining said keyhole, and means for rigidly attaching said flange to said core.

2. The apparatus of claim 1 wherein said means for rigidly attaching said flange to said core includes a plurality of screws.

3. The apparatus of claim 1 wherein said means for rigidly attaching said flange to said core includes adhesive attachment means.

4. The apparatus of claim 1 wherein said means for securing said funnel-shaped element includes a single flange.

* * * * *